US008978572B2

(12) United States Patent
Bolat et al.

(10) Patent No.: US 8,978,572 B2
(45) Date of Patent: Mar. 17, 2015

(54) SUBMARINE

(75) Inventors: Erhan Bolat, Kiel (DE); Christian Knop, Felm (DE); Klaus-Gerrit Mews, Schellhorn (DE); Bernd Scholz, Mönkeberg (DE)

(73) Assignee: ThyssenKrupp Marine Systems GmbH, Kiel (DE)

( * ) Notice: Subject to any disclaimer, the term of this patent is extended or adjusted under 35 U.S.C. 154(b) by 0 days.

(21) Appl. No.: 14/343,616

(22) PCT Filed: Aug. 13, 2012

(86) PCT No.: PCT/EP2012/065824

§ 371 (c)(1),
(2), (4) Date: Mar. 7, 2014

(87) PCT Pub. No.: WO2013/034401

PCT Pub. Date: Mar. 14, 2013

(65) Prior Publication Data

US 2014/0238290 A1 Aug. 28, 2014

(30) Foreign Application Priority Data

Sep. 7, 2011 (DE) ..... 10 2011 082 223

(51) Int. Cl.
*B63G 8/40* (2006.01)
*B63G 8/41* (2006.01)

(52) U.S. Cl.
CPC .. *B63G 8/41* (2013.01); *B63G 8/40* (2013.01); *B63B 2702/12* (2013.01)
USPC ..... 114/336; 405/189; 114/323; 114/313

(58) Field of Classification Search
USPC ..... 114/336, 312
See application file for complete search history.

(56) References Cited

U.S. PATENT DOCUMENTS

| | | | | | |
|---|---|---|---|---|---|
| 1,822,435 | A * | 9/1931 | Gioachino | ..... | 405/189 |
| 2,077,477 | A * | 4/1937 | Hellman | ..... | 114/323 |
| 4,054,104 | A * | 10/1977 | Haselton | ..... | 114/264 |
| 5,947,051 | A * | 9/1999 | Geiger | ..... | 114/313 |
| 6,925,954 | B1 * | 8/2005 | Van Acker et al. | ..... | 114/323 |
| 8,186,294 | B2 * | 5/2012 | Baylot et al. | ..... | 114/221 A |
| 2014/0238290 | A1 * | 8/2014 | Bolat et al. | ..... | 114/336 |

FOREIGN PATENT DOCUMENTS

| | | | |
|---|---|---|---|
| DE | 821317 | * | 11/1951 |
| DE | 821317 C | | 11/1951 |
| GB | 339945 A | | 12/1930 |

OTHER PUBLICATIONS

German Examination Report for 102011082223, Mar. 27, 2012.
International Search Report for PCT/EP2012/065824, Jan. 2, 2013.

* cited by examiner

*Primary Examiner* — Lars A Olson
*Assistant Examiner* — Jovon Hayes
(74) *Attorney, Agent, or Firm* — Panitch Schwarze Belisario & Nadel LLP

(57) ABSTRACT

A submarine is provided with an upwardly directed drilling device (12, 12'). The drilling device (12, 12') is arranged in a pressure hull (4) of the submarine and has a drill (14, 14') which can be extended out of the pressure hull (4) through an opening (10) arranged on the upper deck of the submarine. The drill has a drilling head (42, 42') which forms a closure body which closes the opening (10) of the pressure hull. The drill functions to drill a hole from under an ice sheet to allow occupants of the submarine to exit through the hole.

10 Claims, 3 Drawing Sheets

SUBMARINE

CROSS-REFERENCE TO RELATED APPLICATIONS

This application is a Section 371 of International Application No. PCT/EP2012/065824, filed Aug. 13, 2012, which was published in the German language on Mar. 14, 2013, under International Publication No. WO 2013/034401 A1 and the disclosure of which is incorporated herein by reference.

BACKGROUND OF THE INVENTION

The invention relates to a submarine.

Submarines having a drive which is independent of external air can operate in Arctic waters over a longer period of time below a closed ice sheet. However, with submerged travel below a closed ice sheet, those emergency situations which render it necessary for the crew to leave the submarine have been found to be fatal. In such a situation, the ice sheet or ice layer prevents these persons from getting to above the ice sheet.

BRIEF SUMMARY OF THE INVENTION

Against this background, it is the object of the invention to provide a submarine, which renders it possible for the occupants to exit out of the submarine to above the ice sheet, given submerged travel below a closed ice sheet.

This object is achieved by a submarine having a drilling device which is directed upwards and which is arranged in a pressure hull of the submarine. The drilling device comprises a drill which is extendable out of an opening of the pressure hull arranged on the upper deck side, wherein a drilling head of the drill forms a closure body which closes the opening of the pressure hull. Advantageous further developments of this submarine are to be deduced from the dependent claims, the subsequent description as well as the drawing. Hereby, according to the invention, the features specified in the dependent claims in each case per se but also in a suitable combination can further form the solution according to the invention.

The basic concept of the invention is to equip the submarine with a drilling device which is directed upwards. With such a drilling device, with submerged travel below a closed ice sheet, it is possible to drill a hole into this from below and particularly advantageously an exit hole for the crew of the submarine. The occupants can leave the submarine through this exit hole, for example in the case of an emergency, and get on top of the ice sheet. For this, the drilling device is positioned on or in the submarine, such that a drill arranged outside the submarine body can be applied on the lower side of the ice sheet and drill through this, when the submarine is located directly below the ice sheet. For creating an exit hole in an ice sheet, the drill is usefully dimensioned such that it can create a drill hole whose cross section or diameter renders it possible for a person to climb through here. Preferably, the drill comprises a drilling head whose diameter corresponds at least to the diameter of an exit opening arranged on the submarine on the upper deck side, or is larger. The drilling head can be similar to the drilling heads used in tunnel advancing machines, and at an essentially plane face side, apart from a centering tip arranged in its center, can comprise a multitude of cutters. Apart from this, drilling heads having a conical tip and which comprise several cutters running from the center of the drilling head to its outer periphery can also be provided.

The drilling device can be arranged completely outside a pressure hull of the submarine. Preferably, the drilling device however is arranged in the pressure hull of the submarine and the drill of the drilling device is advantageously extendable out of an opening of the submarine which is on the upper deck side. For this, the drilling device is usefully arranged directly below such an opening of the pressure hull or movable into such a position directly below the opening of the pressure hull. The drill of the drilling device is advantageously directed such that it can be extended, which is to say moved outwards, normally to the opening plane out of the opening.

When the drilling device is not in use, the opening formed on the pressure hull is to be closed in a pressure-tight manner. For this, a cover which closes the opening in a pressure-tight manner and which can be pivoted open outwards before the application of the drilling device can be articulated for example on the edge of the opening in the usual manner. However, a design with which the drilling head of the drill forms a closure body closing the opening of the pressure hull is particularly advantageous. Accordingly, the drilling head of the drill is preferably positioned in a manner such that it closes the opening formed on the pressure hull, in a pressure-tight manner when the drilling device is not used. In this context, a design is advantageous, with which the drilling head has a greater diameter compared to a shank of the drill, at whose end the drilling head is arranged, and thus on the drill forms an annular shoulder projecting radially with respect to the shank. The drill can lay with this shoulder on the outer side of the pressure hull on the edge of the opening formed there and thus close the opening in a pressure-tight manner.

Preferably, the shank of the drill is arranged in a hollow shaft driven in a rotationally movable manner by a rotatory drive and is coupled for movement with the hollow shaft. Accordingly, a hollow shaft, into which the shank of the drill engages, is preferably arranged in the pressure hull below an opening formed on the pressure hull on the upper deck side. The hollow shaft can directly form the drive shaft of a drive motor or, as is preferably envisaged, can be actively connected via a gear to the drive shaft of a drive motor which is arranged next to the hollow shaft and with which it is preferably the case of an electric motor. The shank of the drill in the hollow shaft is connected to the hollow shaft with a positive fit, at least in the rotation direction of this hollow shaft.

The drill can be directly coupled in movement to a rotary drive of the drilling device via its shank. In this case however, it is necessary to displace the drill together with the rotary drive in the direction of the ice sheet to be drilled through, for producing a linear advance movement of the drill. Ideally however, the rotary drive of the drill is arranged in a stationary manner in the pressure hull of the submarine and an advance movement of the drill is possible independently of the rotary drive. For this, the drill is advantageously displaceable in the hollow shaft in its longitudinal direction. This means that the shank of the drill is led in the hollow shaft in a linearly movable manner. Simultaneously however, a rotational movement coupling to the hollow shaft is necessary. For this, at least one slot (groove) which runs parallel to a longitudinal axis of the drill and into which at least one projection formed on the inner side of the hollow shaft or a sliding nut arranged there in a stationary manner engages, can for example be formed on the outer periphery of the shank. Preferably however, two slots which are aligned in the longitudinal direction of the drill and into which in each case a sliding nut arranged on the inner periphery of the hollow shaft in a manner corresponding to the slots of the shank engages, are formed on the outer periphery of the shank in a manner diametrically spaced from one another, for the purpose of a secure torque transmission. With this design, the length of the slot or slots which are formed on the shank determines the possible advance path of the drill.

The drill can be subjected to pressure by a pressure medium preferably at a side facing away from the drilling head, for producing an advance movement of the drill out of the pressure hull of the submarine. For this, a telescopic pneumatic or hydraulic cylinder can engage on the end of the shank of the drill facing away from the drilling head. Advantageously however, the drill and the hollow shaft themselves form such a pressure cylinder which can be subjected to a pressure medium. In this case, the hollow shaft usefully forms a part of a pressure chamber of the pressure cylinder. This pressure chamber can preferably be filled with seawater as a pressure medium. This seawater can be pumped from the outer environment of the submarine into the pressure chamber via a conduit leading from the outer environment of the submarine into the pressure chamber.

On drilling an exit hole through an ice sheet, the submarine usually bears with its upper side directly on the lower side of the ice sheet. Advantageously, with the submarine according to the invention, deformation bodies are arranged on its outer side on the upper deck side, in order to prevent damage to the submarine on moving the submarine into this position. These deformation bodies form a crumple zone or resilient buffer between the submarine and the ice sheet. Elastic bags filled with seawater and deformable tubular structures can for example be applied as deformation bodies. Moreover, the use of commercially available fenders as deformation bodies is also possible.

Movements of the submarine relative to the exit hole should be prevented during the drilling of an exit hole through the ice sheet and during the exit out of the submarine through this exit hole. For this purpose, with the submarine according to the invention, advantageously anchoring devices which can be extended out of the submarine on the upper deck side and are envisaged for anchoring the submarine on the ice sheet are provided. The anchoring devices are arranged on the submarine in a manner spaced from one another in the longitudinal direction of the submarine, preferably on two sides of the opening of the pressure hull, through which the drill is extended, the sides facing diametrically away from one another. They can advantageously each comprise a multitude of tips which on extending the anchoring devices penetrate into the ice sheet and thus fix the submarine on the ice sheet with a positive fit. The anchoring devices are preferably designed in a hydraulically displaceable manner, in order to be able to press the anchoring devices with an as large as possible pressing pressure onto the lower side of the ice sheet.

After an exit hole has been drilled into the ice sheet with the drilling device, and the drill has been brought into the submarine again, the submarine is to be moved into such a position, in which it is located directly below the drilled exit hole with an exit opening of the submarine. For this, the submarine can usefully comprise an auxiliary drive, for example in the form of at least one inline thruster. A cover otherwise closing the exit opening is opened when the submarine is located in the position, in which the exit opening of the submarine is below the drilled exit hole. With the submarine according to the invention, further advantageously, an inflatable pressure hose forming an exit channel can be provided on the outside of the exit opening, in order in this situation, to prevent seawater from flowing into the submarine via the exit opening which is now open. This pressure hose before its deployment is firstly folded together in a space-saving manner and is inflated before the opening of the cover of the exit opening, by which it expands in the direction of its middle axis, until, departing from the edge of the exit opening, it extends through the ice sheet until above the ice sheet. In this condition, the pressure hose seals the exit opening with respect to the seawater located on the outer side of the pressure hose.

A design of the submarine according to the invention, with which the drill forms an exit lock out of the submarine, is particularly advantageous. The use of the drill as an exit lock is advantageous, inasmuch as the submarine no longer needs to be moved after drilling through the ice sheet for creating an exit hole, since the exit lock for leaving the submarine is already located directly below the exit hole formed in the ice sheet. With the formation of an exit lock, the shank of the drill is designed in a hollow manner and can be closed in a pressure tight manner at its two ends, in each case with a removable closure. Advantageously, the pressure chamber located below the shank can advantageously serve as an access to the shank. For this, this usefully has an access opening which can be closed in a pressure-tight manner with a closure. The inner diameter of the shank of the drill is typically dimensioned such that a person can get into the cavity formed in the shank. Advantageously a climbing aid, for example a preferably telescopic ladder can be arranged in the shank, in order to get to the upper end of the shank of the drill. In an advantageous further development of the design, with which the drill forms an exit lock out of the submarine, the drilling head of the drill advantageously forms an outer cover as an exit lock. Accordingly, the drilling head can be removed from the shank.

BRIEF DESCRIPTION OF THE SEVERAL VIEWS OF THE DRAWINGS

The invention is hereinafter explained in more detail by way of two embodiment examples represented in the drawings. In the drawings are shown.

DETAILED DESCRIPTION OF THE INVENTION

Figure 2:
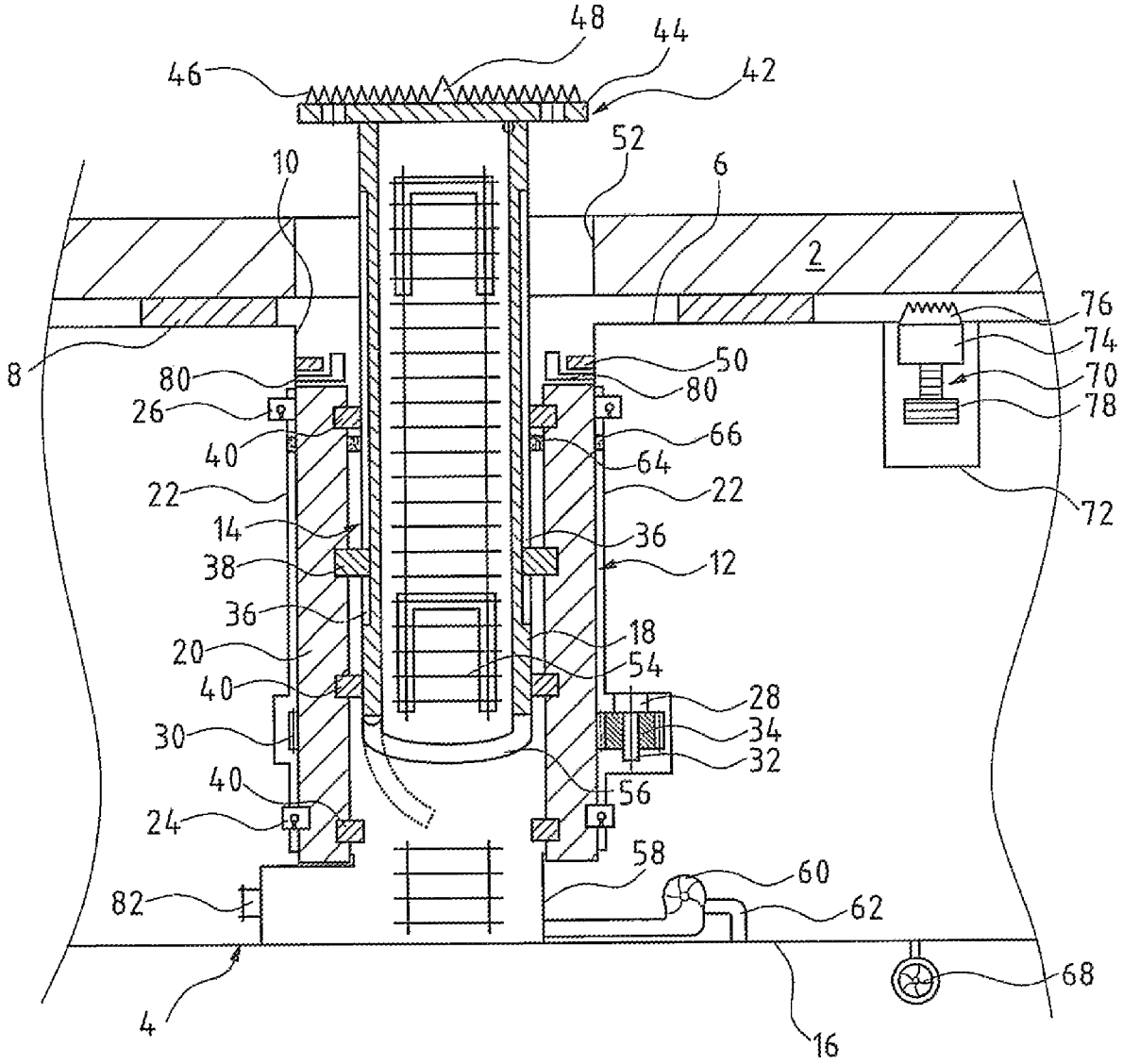
FIG. 2 is a representation according to FIG. 1, having an extended drill of the drilling device.
Figure 3:
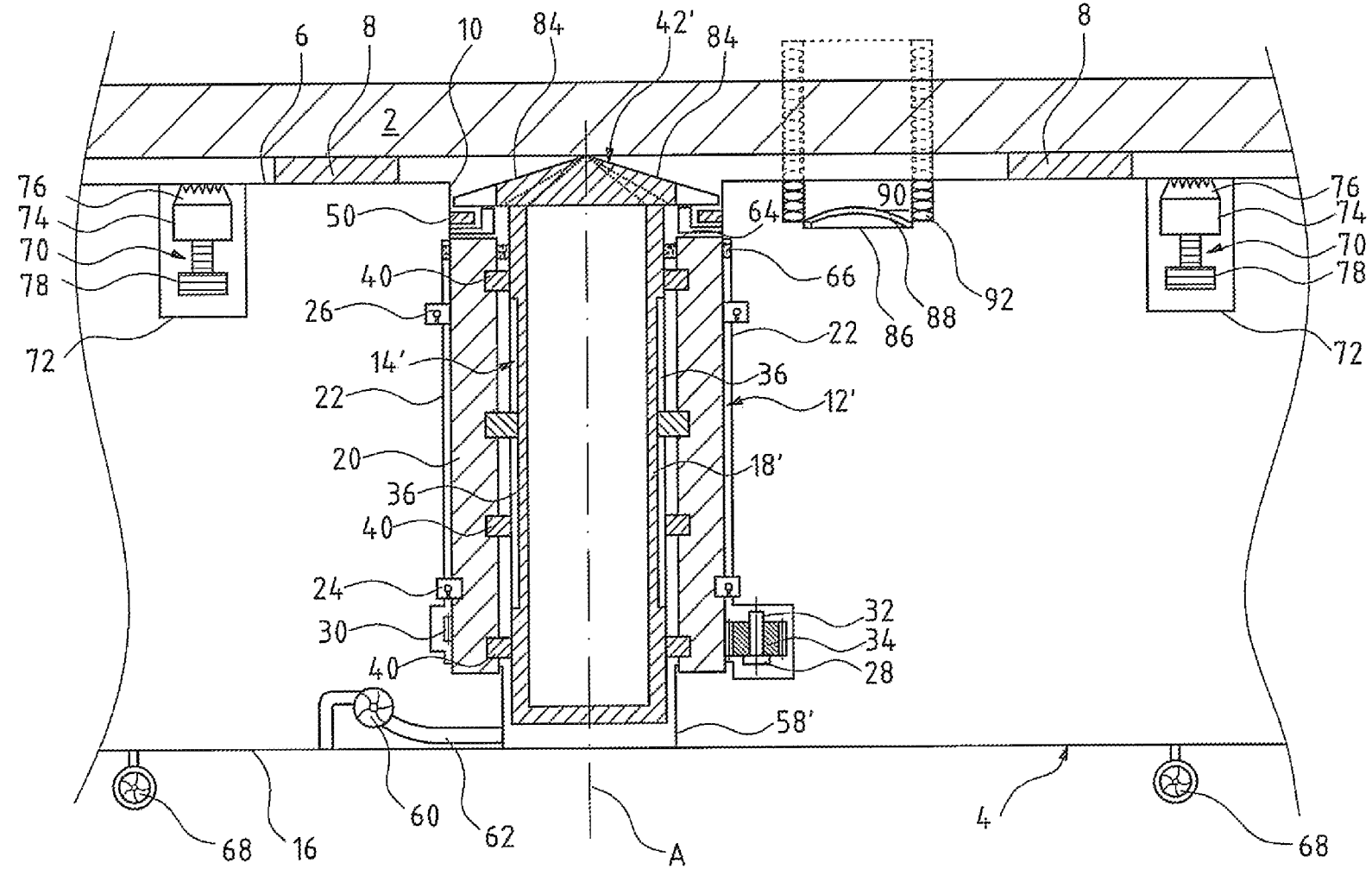
FIG. 3 is a schematically greatly simplified basic sketch, in a sectional view, of a section of a second submarine having a drilling device according to a second embodiment of the invention.

The submarine represented in FIGS. 1 and 2, as well as the submarine represented in FIG. 3, is located in a submerged position below an ice sheet 2. Both submarines comprise a pressure hull 4. Deformation bodies 8 are arranged on an upper side of the pressure hull 4 of the submarines, which in each case also forms an upper deck of the submarine concerned. The submarines bear with these deformation bodies 8 on the lower side of the ice sheet 2, wherein the deformation bodies 8 form a deformable crumple zone between the ice sheet 2 and the submarines.

With both submarines, in each case an opening 10 is formed on the upper side of the pressure hull 4, which is to say on the upper deck side. With the submarine represented in FIGS. 1 and 2, a drilling device 12, and with the submarine represented in FIG. 3 a drilling device 12', is arranged essentially directly below this opening 10, within the pressure hull 4.

Figure 1:
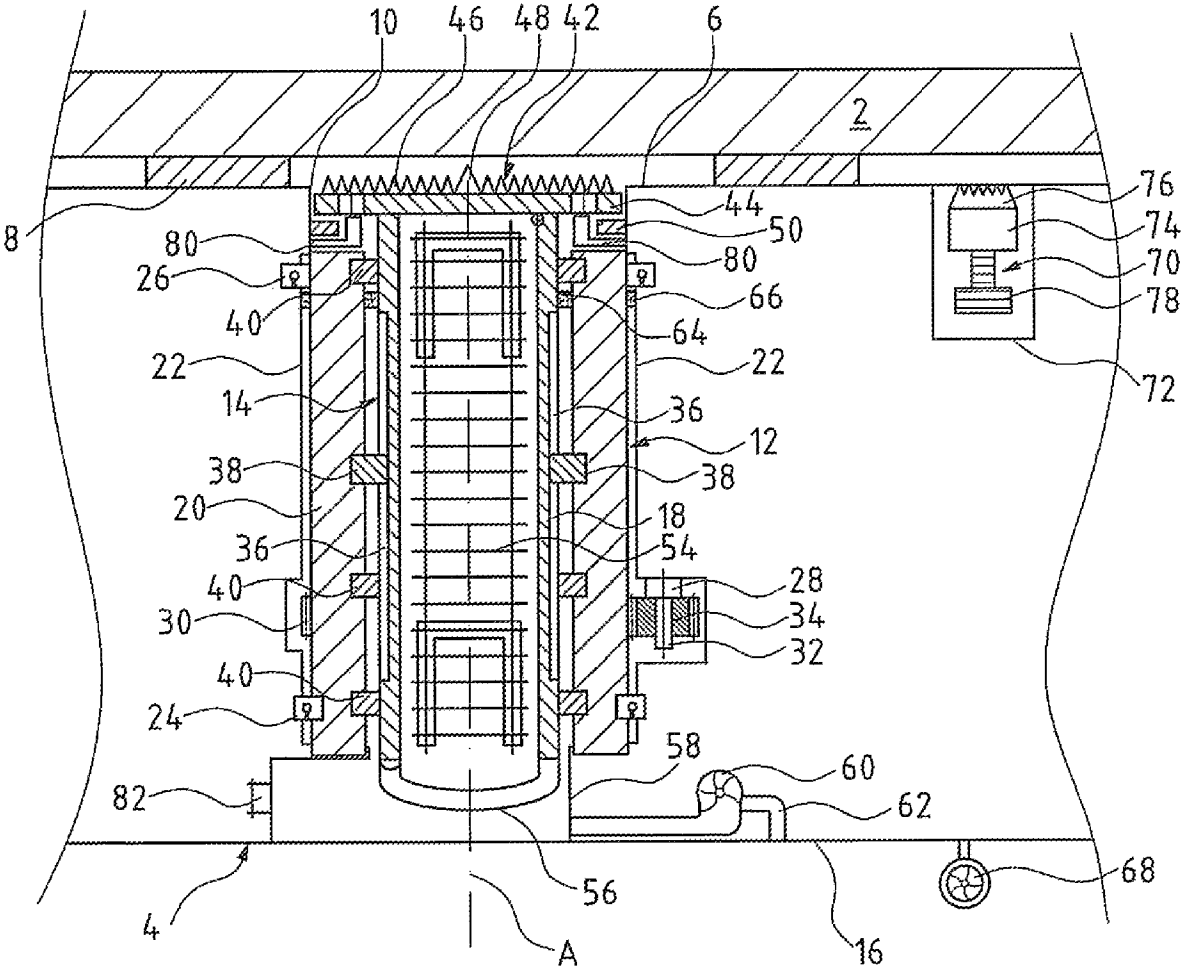
FIG. 1 is a schematic greatly simplified basic sketch, in a sectional view, of a section of a submarine having a drilling device according to a first embodiment of the invention.

The drilling device 12 of the submarine according to the FIGS. 1 and 2 comprises a drill 14, whereas the drilling device 12' of the submarine according to FIG. 3 comprises a drill 14'. As is to be deduced from FIGS. 1 and 3, the length of the drills 14 and 14' is selected such that, in each case in a storage position in the pressure hull 4 of the submarine concerned, they extend in a manner aligned normally to the longitudinal extension of the submarine from a keel 16 to its upper deck 6.

The drill 14 as well as the drill 14' in each case comprises a shank 18 and 18', respectively, which is arranged in a hollow shaft 20. This hollow shaft 20 with the drilling device 12 of the submarine according to FIGS. 1 and 2, as well as with the drilling device 12' of the submarine according to FIG. 3, is envisaged as a drive shaft for the drill 14 and 14' respectively.

With both represented submarines, the hollow shaft 20 is rotatably mounted about a longitudinal axis A within the pressure hull 4 on a support structure 22 normal to the longitudinal extension of the respective submarine by way of two roller bearings 24 and 26, wherein the roller bearing 24 is designed as a fixed bearing and the roller bearing 26 as a loose bearing. The hollow shafts 20 of both submarines are driven in each case by an electric motor 28. A toothed ring 30 which is engages with a toothed wheel 34 arranged on a drive shaft 32 of the electric motor 28 is arranged on the outer periphery of the hollow shaft 20, for movement coupling of the hollow shaft 20 to the electric motor 28.

The shank 18 of the drill 14 of the drilling device 12 of the submarine according to FIGS. 1 and 2, as also the shank 18' of the drill 14' of the drilling device 12' of the submarine according to FIG. 3, is each connected to the hollow shaft 20 in a rotationally movable manner and is simultaneously linearly displaceable in the direction of the longitudinal axis A. For this, the shanks 18 and 18' at their outer periphery each comprise two slots 36, which run parallel to the longitudinal axis A and which are arranged on two sides of the shank 18 and 18' respectively, the sides facing diametrically away from one another. A slot nut 38 engages into both slots 36 in each case. The slot nuts 38 are fastened on the inner side of the hollow shafts 20 and create such a positive-fit between the hollow shaft 20 and the shank 18 and 18' arranged thereon, that the shank 18, 18' on the one hand is connected to the hollow shaft 20 in a rotationally movable manner, but on the other hand can be displaced relative to the shaft 20. Three guide bushings 40, on which the shank 18 and 18' bears in a guided manner are fastened on the inner side of the hollow shaft 20 in its longitudinal direction in a manner spaced from one another, for the rotationally movable as well as linearly displaceable guiding of the shank 18 and 18' in the hollow shaft 20.

Firstly, only the drilling device 12 of the submarine represented in FIGS. 1 and 2 is hereinafter explained in more detail.

With the drill 14 of the drilling device 12, a drilling head 42 is arranged at the end of the shank 18 which is on the upper deck side. The drilling head 42 is formed by a plane disk 44 on whose face side away from the shank 18 a plurality of cutters 46 are arranged next to one another. Moreover, a centering tip 48 is arranged centrally on the face side of the disk 44 facing away from the shank 18.

The drilling head 42 of the drill 14 forms a closure body for closure of the opening 10 (FIG. 1) which is formed on the pressure hull 4. Accordingly, the outer diameter of the drilling head 42 corresponds to the inner diameter of the opening 10. The outer diameter of the drilling head 42 is larger than the outer diameter of the shank 18 of the drill 14. In this manner, the drilling head 42 forms an annular shoulder which projects radially outwards with respect to the shank 18. The drilling head 42 with this shoulder, in a storage position of the drill 14 in the pressure hull 4 of the submarine, lies on a bracket bushing 50, which projects radially inward on the inner periphery of the opening 14. In this manner, the drill 14 is axially mounted in the pressure hull 4 in its storage position.

A hole 52 can be drilled into the ice sheet 2 which is located above the submarine, with the drill 14, and this hole permits an exit out of the submarine to the upper side of the ice sheet 2 (FIG. 2) for the crew of the submarine. Hereby, the drill 14 with the submarine represented in FIGS. 1 and 2 forms an exit lock out of the submarine. For this, the shank 18 is designed in a hollow manner and a preferably telescopic ladder 54 is arranged in the cavity of the shank 18, via which ladder the occupants of the submarine can get to the drilling head 42, which is removably fastened on the shank 18 and which, after a hole 52 has been drilled into the ice sheet 2 by the drill 14, is moved into a position permitting an exit through the drilled hole 52.

During the drilling procedure, the end of the shank 18 facing away from the drilling head 42 and which otherwise forms an access into the inside of the shank 18, is closed by a cover 56 which is pivotably articulated on the end of the shank 18. The shank 18 and thus the drill 14 are subjected to pressure by a pressure medium at this cover 56, in order to produce an axial advance of the drill 14 during the drilling procedure. For this, a pressure chamber 58 (not represented true to scale in the drawing) connects to the end of the hollow shaft 20 facing away from the keel 16 of the submarine. Seawater is pumped via a conduit 60 leading from the keel 16 of the submarine into the pressure chamber 58 by way of a pump 60, for producing an advance movement of the drill 14.

By way of this, the cover 56 is impinged with pressure and the drill 14 is moved in the direction of the ice sheet 2. The opening 10 which is formed on the pressure hull 4 is then no longer closed in a pressure-tight manner by the drilling head 42 of the drill 14. In this situation, the hollow shaft 20 is sealed with respect to the shank 8 of the drill 14 by way of a seal 64, and sealed off with respect to the support structure 22 by way of a seal 66.

The drilling of a hole 52 in an ice sheet 2 and a subsequent exit out of the submarine to above the ice sheet is effected as follows with the submarine according to FIGS. 1 and 2.

First, the submarine is maneuvered to directly below the ice sheet 2. This can be effected with an auxiliary drive arranged on the keel 16 of the submarine, here in the form of inline thrusters 68. As soon as the submarine with the deformation bodies 8 bears on the lower side of the ice sheet 2, it is anchored on the ice sheet 2. For this, the submarine comprises anchoring devices 70, which are arranged in indentations 42 formed on the pressure hull 4 on the upper deck side. The anchoring devices 70 comprise an anchoring body 74 which, on its side which points away from the pressure hull 4, is provided with a multitude of tips 76. The anchoring bodies 74 of the anchoring devices 70 are mounted in each case on a hydraulic cylinder 78. The hydraulic cylinders 78 which are preferably connected to a central hydraulic system of the submarine are extended, by which the tips 76 formed on the anchoring bodies 74 press into the lower side of the ice sheet 2, in order to anchor the submarine on the ice sheet 2. The submarine is now anchored on the ice sheet 2.

Subsequently, the drilling procedure begins, with which the drill 14 is set into a rotational movement via the hollow shaft 20 driven by the electric motor 28, and experiences an axial advance in the direction of the ice sheet 2 due to the filling of the pressure chamber 58. The ice chips, which arise with the drilling procedure and which fall into the opening 10 formed on the pressure hull 4, are blown into the outer environment of the submarine by way of pressurized air nozzles 80, which project into the opening 10, laterally next to the drill 14.

As soon as the drill 14 has completely penetrated the ice sheet 2, the drill 14 is retracted back again into the pressure hull 4 of the submarine. This is effected by way of pumping the pressure chamber 58 empty. When the pressure chamber 58 is emptied, a closure 82, which is provided on the pressure chamber 58 and otherwise closes the pressure chamber 58 in a pressure tight manner, is opened. An opening is released due to the opening of the closure 82, through which opening a person can climb into the pressure chamber 58 and can open the cover 56 closing the lower end of the shank 18. The drilling head 42 can have already automatically been released from the shank 18 beforehand or it can be opened manually by the person who is located in the pressure chamber 58 and who in the shank 18 climbs up to the drilling head 42 via the ladder 54. An access to the upper side of the ice sheet 2, via which the occupants of the submarine can leave the submarine, now exists from the pressure hull 4 of the submarine.

With the submarine represented in FIG. 3, the drill 14' does not form an exit lock out of the submarine. Although the shank 18' of the drill 14' is designed in a hollow manner for weight reasons, the end of the shank 18' which faces the keel 16 of the submarine is however closed in a fixed manner.

With the submarine represented in FIG. 3, a drilling head 42' of the drill 14', which is arranged on the end of the shank 18', the end facing away from the keel 16 of the submarine, also forms a closure body for closing the opening 10 which is formed on the pressure hull 4 at the upper deck side. This drilling head 42' also has an outer diameter which corresponds to the inner diameter of the opening 10 and is greater than the outer diameter of the shank 18'. The drilling head 42' with a radially outwardly projecting shoulder designed in such a manner also lies on a bracket bushing 50, which projects radially inward on the inner periphery of the opening 10.

The drilling head 42' is designed in a cone-shaped manner, wherein it tapers in a pointed manner from a large outer diameter, which corresponds to the inner diameter of the opening 10, in the direction away from the shank 18'. Four cutters 84, which project in the axial direction of the drill 14' and whose shape corresponds essentially to the shape of the main cutters of a common spiral drill, are formed on the side of the drilling head 42' facing away from the shank 18'

As with the submarine according to FIGS. 1 and 2, with the submarine according to FIG. 3, a pressure chamber 58' (not represented true to scale in the drawing) also connects to the end of the hollow shaft 20 which faces the keel 16 of the submarine, the hollow shaft being sealed with respect to the shank 8 of the drill 14 by way of a seal 64 and with respect to the support structure 22 by way of a seal 66. Seawater is pumped by way of a pump 60 via a conduit 62' leading from the keel 16 of the submarine to the pressure chamber 58 into the pressure chamber 58', for producing an advance movement of the drill 14'.

The drilling of a hole 52 in an ice sheet 2 and a subsequent exit out of the submarine to above the ice sheet is effected with the submarine according to FIG. 3 as follows:

After it has been maneuvered by way of the inline thrusters 68 up to directly below the ice sheet 2, the submarine is anchored on the ice sheet 2 with anchoring devices 70, whose design and arrangement corresponds to that of the submarine according to FIGS. 1 and 2.

The drilling procedure is effected thereafter, with which the drill 14' is set into a rotational movement via the hollow shaft 20 driven by the electric motor 28 and is pressed against the ice sheet 2 by way of filling the pressure chamber 58'. The ice chips which arise with the drilling procedure are led away to the outside in the intermediate spaces between the cutters 84 of the drilling head 42', where they are blown into the outer environment of the submarine by way of pressurized air nozzles 80 projecting into the opening 10, laterally next to the drill 14.

As soon as the drill 14' has completely penetrated through the ice sheet 2, the drill 14' is retracted again into the pressure hull 4 of the submarine, wherein the drilling head 42' closes the opening 10 of the pressure hull 4 in a pressure-tight manner. The refraction of the drill 14' is effected as the retraction of the drill 14 in the submarine represented in FIGS. 1 and 2.

Subsequently, the anchoring bodies 74 of the anchoring devices 70 are retracted so that the submarine can move freely again. The submarine is then maneuvered with the help of the inline thruster 68, such that an exit opening 86 arranged on the pressure hull 4 on the upper deck side is located directly below an exit hole, which is drilled by the drill 14' into the ice sheet 2.

The exit opening 86, which is closed by a cover 88 in a pressure-tight manner, is arranged in a recess 90. The recess 90 has a larger diameter than the cover 88 closing the exit opening 86. An inflatable pressure hose 92 is mounted in a folded manner on an annular shoulder of the recess 90, which is formed around the cover in such a manner. This pressure hose is now inflated, by which it expands in the longitudinal direction through the hole drilled into the ice sheet 2, and projects at the upper side of the ice sheet 2. The cover 88 is now opened, wherein the pressure hose 92 prevents seawater from being able to get into the submarine via the exit opening 86. The occupants of the submarine can now exit this to the upper side of the ice sheet 2.

We claim:

1. A submarine comprising a pressure hull (4) having an opening (10) arranged on an upper deck side of the submarine and a drilling device directed upward and arranged in the pressure hull, the drilling device comprising a drill (14, 14') extendable out of the opening (10), wherein the drill has a drilling head (42, 42') which forms a closure body which closes the opening (10) of the pressure hull.

2. The submarine according to claim 1, wherein the drill (14, 14') comprises a shank (18, 18') arranged in a hollow shaft (20) rotationally movably driven by a rotary drive and coupled in movement to the hollow shaft (20).

3. The submarine according to claim 2, wherein the drill (14, 14') is displaceable in the hollow shaft (20) in its longitudinal direction.

4. The submarine according to claim 2, wherein the drill (14, 14') is subjected to pressure with a pressure medium at a side facing away from the drilling head (42, 42').

5. The submarine according to claim 2, wherein the hollow shaft (20) forms a part of a pressure chamber (58, 58') fillable with seawater.

6. The submarine according to claim 1, further comprising deformation bodies (8) arranged on an outer side of the submarine on the upper deck side.

7. The submarine according to claim 1, further comprising anchoring devices (70) extendable out of the submarine on the upper deck side for anchoring the submarine on an ice sheet (2).

8. The submarine according to claim 1, further comprising an inflatable pressure hose (92) forming an exit channel on an outer side of an exit opening (86) of the submarine.

9. The submarine according to claim 1, wherein the drill (14) forms an exit lock out of the submarine.

10. The submarine according to claim 9, wherein the drilling head (42) forms an outer cover of the exit lock.

* * * * *